US006155938A

United States Patent [19]

Mower

[11] Patent Number: 6,155,938

[45] **Date of Patent: *Dec. 5, 2000**

[54] BASKETBALL GOAL ASSEMBLY HAVING ONE-HANDED PUSH BUTTON HEIGHT ADJUSTMENT MECHANISM

[75] Inventor: Barry D. Mower, Layton, Utah

[73] Assignee: Lifetime Products, Inc., Clearfield, Utah

[ * ] Notice: This patent is subject to a terminal disclaimer.

[21] Appl. No.: 09/248,641

[22] Filed: Feb. 11, 1999

Related U.S. Application Data

[63] Continuation-in-part of application No. 09/018,231, Feb. 3, 1998, Pat. No. 6,077,177, which is a continuation-in-part of application No. 08/986,382, Dec. 8, 1997, Pat. No. 5,879,247, which is a continuation of application No. 08/799,979, Feb. 12, 1997, Pat. No. 5,695,417.

[60] Provisional application No. 60/077,855, Mar. 13, 1998.

[51] Int. Cl.[7] ..... A63B 63/08

[52] U.S. Cl. ..... 473/484; 473/483; 473/482; 473/481; 248/283.1; 248/280.11

[58] Field of Search ..... 473/471, 481, 473/482, 483, 484; 248/283.1, 404, 280.11, 161, 162.1

[56] References Cited

U.S. PATENT DOCUMENTS

| | | |
|---|---|---|
| 276,637 | 5/1883 | Slater . |
| D. 350,797 | 9/1994 | Curtis . |
| 1,924,811 | 8/1933 | Schulz . |
| 2,932,511 | 4/1960 | Bemis . |
| 3,427,025 | 2/1969 | Procter . |
| 3,586,324 | 6/1971 | Bearson . |
| 3,765,676 | 10/1973 | Bearson et al. . |
| 3,802,702 | 4/1974 | Pulley . |
| 4,395,040 | 7/1983 | White . |
| 4,438,923 | 3/1984 | Engle et al. . |
| 4,441,709 | 4/1984 | Schroeder et al. . |
| 4,684,129 | 8/1987 | Andersen et al. . |
| 4,781,375 | 11/1988 | Nye . |

(List continued on next page.)

FOREIGN PATENT DOCUMENTS

| | | |
|---|---|---|
| 28616 | 2/1965 | Netherlands . |

OTHER PUBLICATIONS

"Introducing New Huffy Elevator," Informational Brochure, Huffy Sports, Waukesha, Wisconsin (date unknown).

"Adjustable Backstop Support, Backboard and Goal Kit," Informational Brochure, Wilson, Franklin Park, Illinois (date unknown).

(List continued on next page.)

*Primary Examiner*—Raleigh W. Chiu
*Attorney, Agent, or Firm*—Madson & Metcalf

[57] ABSTRACT

The present invention relates to a push button height adjustment mechanism for a basketball goal assembly for adjusting the height of a basketball goal above a playing surface. The basketball goal assembly includes a deformable goal support structure interposed between a rigid support member and a basketball goal. A first end of an extension arm pivotally connects to an extension that protrudes from the back side of the goal support structure. A second end of the extension arm is pivotally connected to the support member. An adjustment mechanism disposed in relation to the extension arm allows the length of the extension arm to be adjusted. The adjustment of the length of the extension arm selectively deforms the goal support structure, thereby adjusting the height of the basketball goal in relation to the playing surface. A counterbalance member is operably disposed in relation to the goal support structure to facilitate counterbalancing between the weight of the basketball goal and a tensile force applied to the extension arm. The adjustment mechanism may comprise a spring-biased push button mechanism. With the use of the spring-biased push button mechanism, a user is capable of adjusting the height of the basketball goal in relation to the playing surface using only a single hand.

25 Claims, 4 Drawing Sheets

U.S. PATENT DOCUMENTS

| | | |
|---|---|---|
| 4,798,381 | 1/1989 | Dadbeh . |
| 4,801,142 | 1/1989 | Friesen . |
| 4,805,904 | 2/1989 | Nye . |
| 4,846,469 | 7/1989 | Nye . |
| 4,881,734 | 11/1989 | Nye . |
| 5,133,547 | 7/1992 | Pardi . |
| 5,158,281 | 10/1992 | Williams . |
| 5,259,612 | 11/1993 | Matherne et al. . |
| 5,388,821 | 2/1995 | Blackburn . |
| 5,465,957 | 11/1995 | Schroeder . |
| 5,478,068 | 12/1995 | Schroeder . |
| 5,503,390 | 4/1996 | Hall . |
| 5,573,237 | 11/1996 | Van Nimwegen et al. . |
| 5,573,238 | 11/1996 | Aaron et al. . |
| 5,601,284 | 2/1997 | Blackwell et al. . |
| 5,695,417 | 12/1997 | Winter et al. . |
| 5,720,679 | 2/1998 | Schroeder . |
| 5,738,601 | 4/1998 | Hughes . |
| 5,879,247 | 3/1999 | Winter et al. . |

OTHER PUBLICATIONS

"All–in–One Quick Adjust Kits," Informational Brochure, Porter (date unknown).

"Component Play Grounds", Equipment Brochure, Salt Lake City, Utah, p. 6 (date unknown).

Diversified Products, "DP Fit for Life," 1990 Equipment Catalog, Opelika, Alabama, p. 61.

Huffy Sports, "Basketball's Hottest Products this Year," Equipment Catalog, Waukesha, Wisconsin (date unknown).

Huffy Sports, Equipment Catalog, Waukesha, Wisconsin, p. 21 (date unknown).

Diversified Products, "25 Years of Innovation," Opelika, Alabama, p. 69 (date unknown).

Huffy Sports, "Our All–Star Lineup," Waukesha, Wisconsin, p. 21 (date unknown).

Harvard, "1988 Sporting Goods Catalog," p. 8.

Huffy Sports, Equipment Assembly Instruction Sheet, Waukesha, Wisconsin (date unknown).

BASKETBALL GOAL ASSEMBLY HAVING ONE-HANDED PUSH BUTTON HEIGHT ADJUSTMENT MECHANISM

RELATED U.S. APPLICATIONS

This application claims the benefit of U.S. Provisional Application Ser. No. 60/077,855 filed Mar. 13, 1998 and entitled ADJUSTABLE BASKETBALL GOAL SYSTEM and is a continuation-in-part of our patent application Ser. No. 09/018,231 filed Feb. 3, 1998 now U.S. Pat. No. 6,077,177 and entitled ADJUSTABLE BASKETBALL GOAL SYSTEM, which is a continuation-in-part of application Ser. No. 08/986,382 filed Dec. 8, 1997 now U.S. Pat. No 5,879,247 and entitled POWER LIFT BASKETBALL ADJUSTMENT SYSTEM, which is a continuation of application Ser. No. 08/799,979 filed Feb. 12, 1997 and entitled POWER LIFT BASKETBALL ADJUSTMENT SYSTEM, now issued as U.S. Pat. No. 5,695,417. The foregoing applications are hereby incorporated herein by reference.

BACKGROUND OF THE INVENTION

1. The Field of the Invention

The present invention is related to an apparatus and method for adjusting the height of a basketball goal assembly and, more particularly, to a novel counterbalanced basketball adjustment system having a telescoping extension arm that is adjustable between a plurality of positions by a push button mechanism which facilitates convenient positioning of a basketball goal in relation to a playing surface.

2. The Relevant Technology

Basketball is an increasingly popular sport in the United States and abroad. There are many cities, counties and other associations that sponsor recreational and instruction leagues where people of all ages can participate in the sport of basketball. Today there are organized leagues for children as young as five and six years old. Accordingly, it is not surprising that more and more people are mounting basketball goals on their property.

The problem with many basketball goals is that the goal is usually fixed at a certain height above the playing surface. That height is generally the standard basketball goal height of ten (10) feet. Younger children, however, simply don't have the strength to make a basket at the general standard height of ten feet. Many children, accordingly, may develop improper shooting skills in order to throw a basketball toward a goal that is too high. Oftentimes, children get frustrated with the sport and give it up. Other people may want to experience the feeling of dunking a basketball but are too short to do so. To this end, fixed-height basketball goals make such an experience impossible for many people.

Many attempts have been made to design a basketball goal which is adjustable to several different heights. Adjustable basketball goals allow people of all ages and sizes to enjoy the sport by adjusting the basketball goal to a height above the playing surface that is convenient for them. Some of these basketball goals employ a deformable parallelogramic linkage design that connects the basketball backboard to a rigid support member such as a pole. In operation, these prior art deformable parallelogram linkages are generally lockable to secure the basketball goal at a predetermined height above the playing surface.

One disadvantage of prior art adjustable basketball goal assemblies is that the locking mechanism or adjustment is positioned within or near the parallelogram linkage, which is commonly located well above the playing surface. When a user desires to adjust the height of the basketball goal, the user is typically required to use a ladder, stool or the like to reach the adjustment mechanism and mechanically "unlock" the basketball goal. As appreciated, this creates the potential danger of the user falling.

Other types of adjustable basketball goals have adjustment systems that are accessible with the use of a rod or pole such as, for example, a broomstick handle. Oftentimes, there is no such adjustment device readily available. The user must therefore suffer the inconvenience of finding a suitable implement, or simply choose not to adjust the height of the basketball goal above the playing surface.

Other prior art adjustable basketball goals may be configured such that the entire weight of the basketball goal bears directly on the adjustment mechanism. One disadvantage of this design is that it takes more strength and patience to adjust than children or young adults typically possess. This is unfortunate because it is usually small children who have the greatest need for adjusting the basketball goal.

To overcome this problem, many basketball goal assemblies were developed that provided an adjustment mechanism having a heavy counterbalancing beam to counteract the weight of the basketball goal. Such adjustment systems are generally very bulky, expensive to manufacture and transport, and are typically difficult to assemble.

Another disadvantage of many prior art adjustable basketball goal assemblies is that the adjustment mechanism has a locking member which is separate and distinct from the adjustment mechanism. Accordingly, two hands are needed to simultaneously unlock the lock, adjust the adjustment mechanism and then lock the locking member in a predetermined position. In addition, many adjustable basketball goal assemblies comprise prior art locking and adjustment mechanisms that are complex in design, requiring a large number of working components in order to simultaneously and easily adjust and lock the basketball goal system in one of its plurality of configurations. As appreciated, this type of design increases the cost and complexity of manufacturing the basketball goal assembly.

From the foregoing, it will be appreciated that it would be an advancement in the art to provide an adjustable basketball goal assembly that can be adjusted by a user standing at ground level without the use of a ladder or a pole. It would be a further advancement to provide such an adjustable basketball goal assembly that could be adjusted quickly and easily using a single hand of a user. Finally, it would be another advancement in the art to provide such an adjustable basketball goal assembly that is simple in design, cost effective to manufacture and transport, and easy to assemble.

OBJECTS AND BRIEF SUMMARY OF THE INVENTION

The apparatus of the present invention has been developed in response to the present state of the art, and in particular, in response to the problems and needs in the art that have not yet been fully resolved by currently available basketball goals. Thus, it is an overall objective of the present invention to provide a basketball goal which overcomes many or all of the shortcomings in the art discussed above.

To achieve the foregoing object, and in accordance with the invention as embodied and broadly described herein in the presently preferred embodiment, a novel adjustable basketball goal assembly is provided. The basketball goal assembly of the present invention includes a rigid support member which extends in a substantially upward direction.

The rigid support member has a goal side and a back side opposite the goal side.

A deformable goal support structure is preferably pivotally attached to the goal side of the rigid support member such that the goal support structure is suspended above the playing surface. A basketball goal is preferably attached to the goal support structure adjacent the goal side of the rigid support member. In one presently preferred embodiment, the basketball goal includes a rim, a backboard and a net. The goal support structure is configured such that, as the goal support structure deforms, the height of the basketball goal above the playing surface changes, each height corresponding to a different deformation. Specifically, the configuration of the goal support structure allows the rim of the basketball goal to be adjusted to several different heights while remaining horizontally disposed in relation to the playing surface.

An extension arm is preferably disposed between the goal support structure and the rigid support member. Preferably, the extension arm is attached at a first end to the goal support structure, extending down along the back side of the rigid support member. A second end of the extension arm is attached by a mounting bracket to the back side of the rigid support member at an intermediate point along the length of the rigid support member.

In one presently preferred embodiment, the extension arm is divided into two telescoping members. An inner segment of the extension arm may be attached to the mounting bracket and an outer segment may be connected to a lower linkage arm of the deformable goal support structure. The lower linkage arm extends to the back side of the rigid support member and is pivotally fixed at an intermediate point to the rigid support member. An extension arm portion of the lower linkage arm extends rearward from the rigid support member to serve as a lever, such that adjustments in the length of the extension arm are translated through the lower linkage arm and to the goal support structure. The goal support structure is thereby deformed, altering the height of the basketball goal in relation the playing surface.

An adjustment mechanism is preferably disposed on the extension arm for adjusting the linear length of the extension arm. The adjustment mechanism may comprise a plurality of aligned holes disposed lengthwise in the upper segment and a spring-loaded push button mechanism disposed in the lower segment. Functionally, the inner segment is disposed partially within the outer segment and a head of the spring-loaded push button mechanism is aligned to engage one of the plurality of aligned holes. The spring-loaded push button mechanism is engageable with one of the aligned holes at a time. The particular hole within which the push button is disposed determines the length of the extension arm.

Depressing the head of the spring-loaded push button disengages the spring-loaded push button mechanism from the hole in the outer segment with which it was previously engaged. While the spring-loaded push button mechanism is so depressed, the inner segment may be freely moved within the outer segment. When the head of the spring-loaded push button mechanism is no longer depressed, it springs back out to engage the first of the aligned holes that comes into alignment with the spring-biased head. This engagement with a new hole thereby locks the adjustment mechanism in place and establishes a new length of the extension arm. The new length of the extension arm consequently determines a new height for the basketball goal in relation to the playing surface.

Under this preferred arrangement, a user can simultaneously depress the spring-biased push button mechanism and adjust the length of the extension arm with a single hand. In operation, shortening the extension arm draws the leveraging extension on the lower linkage arm down toward the playing surface, causing the height of the basketball goal to rise. Whereby, lengthening the extension arm causes the leveraging extension on the lower linkage arm to rise, thus lowering the basketball goal.

The adjustment mechanism may also be characterized in terms of an engagement member operably disposed in relation to the extension arm for engaging with one or more of a plurality of receiving orifices linearly disposed within the engagement member. The engagement member may be the push button mechanism as described above, or may be a pin or other mechanism for fixing the extension arm with regards to the support member utilizing the plurality of receiving orifices. As appreciated, the engagement member could be disposed within the extension arm as described or could be directly connected with the mounting bracket or the support member.

The basketball goal is preferably counterbalanced with a counterbalance member attached to the goal support structure. The counterbalance member provides a force which substantially counterbalances the gravitational force acting on the adjustable basketball goal system due to the weight of the basketball goal. In one presently preferred embodiment, the counterbalance member comprises a coil spring disposed in such a manner so as to apply a compressive force between the upper and lower linkage arms.

Thus it is an advantage of the present invention to provide a one-handed push button height adjustment assembly for a basketball goal assembly that is conveniently adjustable, cost effective to manufacture, and easy to assemble. It is another advantage of the present invention that such a height adjustment assembly is provided that is adjustable without the aid of a ladder or pole. It is a further advantage of the present invention that the height adjustment assembly can be unlocked and the height simultaneously adjusted with the use of a single hand. It is also an advantage of the present invention that repositioning of the basketball goal requires only a minimal force.

These and other objects, features and advantages of the present invention will become more fully apparent from the following description and appended claims, or may be learned by the practice of the invention as set forth hereinafter.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 5, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
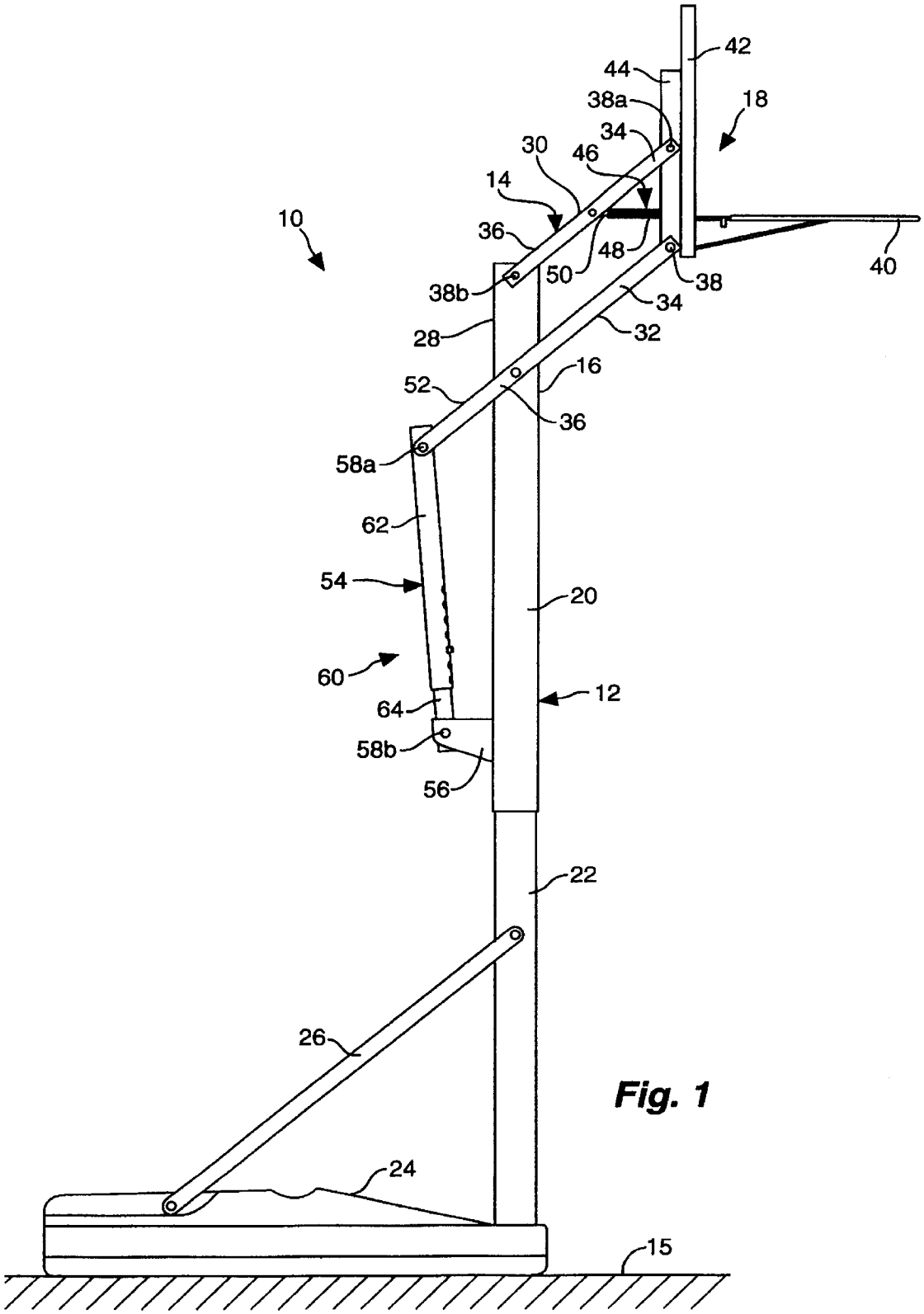
FIG. 1 is a side plan view illustrating a presently preferred embodiment of a height adjustment mechanism for a basketball goal assembly of the present invention.

With reference now to FIG. 1, one presently preferred embodiment of the adjustable basketball goal assembly according to the present invention is generally designated at 10. As shown, the adjustable basketball goal assembly 10 includes a rigid support member 12 extending in a substantially upward direction in relation to a playing surface 15. A goal support structure 14 is disposed in relation to the rigid support member 12 adjacent a goal side 16 of the rigid support member 12. A basketball goal 18 is attached to the goal support structure 14 opposite the rigid support member 12. In the depicted embodiment, the goal support structure 14 is parallelogramic in shape and is deformable into a plurality of configurations. At each configuration, the basketball goal 18 is disposed at a different height above the playing surface 15.

In one presently preferred embodiment, the rigid support member 12 includes an upper pole section 20 to which the goal support structure 14 is attached, and a lower pole section 22 which is engageably disposed in relation to the upper pole section 20. For example, the lower pole section 22 may be press fit into the upper pole section 20. This configuration may be utilized to make the system 10 easier and more cost effective to package and for storage.

As shown, the lower pole section 22 may be disposed in relation to a support base 24 having a receiving aperture for receiving and retaining the support member 12 in a generally upright position. In addition, the support base 24 may comprise an internal cavity sufficient for receiving and selectively retaining a ballast material (e.g., water, sand or the like) to support and stabilize the adjustable basketball goal assembly 10 above the playing surface 15. Similarly, a pair of rods 26 may be incorporated to assist in securing the rigid support member 12 in relation to the support base 24. As will be readily appreciated by those skilled in the art, there are a variety of other suitable ways to stabilize a rigid support member or connect a rigid support member to a base which are intended to be incorporated herein.

The goal support structure 14 of the adjustable basketball goal assembly 10 comprises an upper linkage arm 30 and a lower linkage arm 32. The upper and lower linkage arms 30, 32 each have a proximal end 34 and a distal end 36. In one presently preferred embodiment, the proximal ends 34 of the upper and lower supports 30, 32 are pivotally attached to a backing plate 44. The backing plate 44 is preferably disposed at the rear of a backboard 42 of the basketball goal 18. The basketball goal 18 is also shown with a rim 40 extending longitudinally outward from the front of the backboard 42 in a generally perpendicular configuration.

The proximal ends 34 of the upper and lower linkage arms 30, 32 are shown pivotally attached to the basketball goal 18 by fasteners 38*a* (e.g., bolts, screws, rivets or the like) positioned through openings formed within the backing plate 44. The distal ends 36 of the upper and lower linkage arms 30, 32 are shown pivotally attached to the rigid support member 12 by fasteners 38*b* (e.g., bolts, screws, rivets or the like) positioned through openings in the rigid support member 12. It will be appreciated that a variety of fasteners or fastening methods are known in the art to pivotally attach a basketball goal to a rigid support member 12 and any suitable fastening apparatus or manner may be used.

The upper linkage arm 30, lower linkage arm 32, rigid support member 12 and the backing plate 44 define the goal support structure 14. As discussed, the goal support structure 14 is preferably parallelogramic in configuration. Because the upper linkage arm 30 and the lower linkage arm 32 are pivotally mounted at each end 34, 36, the parallelogramic goal support structure 14 can be deformed to reposition the height of the basketball goal 18 while allowing the backboard 42 to remain generally vertically disposed and the rim 40 to remain horizontally disposed at all times.

The adjustable basketball goal assembly 10 is counterbalanced with a resistive member 46 disposed in relation to the goal support structure 14. The resistive member provides a force which substantially counterbalances the gravitational force acting on the adjustable basketball goal assembly 10 by virtue of the weight of the basketball goal 18. In one presently preferred embodiment, the resistive member 46 comprises a coil spring of sufficient rigidity and stiffness to resist the weight of the basketball goal 18. The spring 46 is preferably attached at a proximal end 48 to the backing plate 44 and at a distal end 50 to the upper linkage arm 30 of the goal support structure 14. The counterbalancing provided by the resistive member 46 allows for adjustment of the height of the basketball goal 18 above the playing surface 15 with minimal effort.

It will be appreciated that many different methods could be employed to counterbalance the adjustable basketball goal assembly 10. One such alternate method is to place a spring within the extension arm 54. A piston assembly disposed within the extension arm 54 or the goal support structure 14 could also be used.

In one presently preferred embodiment, at least one of the linkage arms 30, 32 includes a leveraging extension 52 which extends beyond the distal end 36 thereof and substantially outward from a back side 28 of the rigid support member 12. In preferred design, the leveraging extension 52 is an integral part of the lower linkage arm 32. The leveraging extension 52 provides a leveraged point from which to adjust the height of the basketball goal 18. In operation, exerting a downward force on the leveraging extension 52 deforms the goal support structure 14 in such a manner as to raise the basketball goal 18 in relation to the playing surface. Whereby, allowing the leveraging extension 52 to rise upward, deforms the goal support structure 14 in a manner which lowers the basketball goal 18 in relation to the playing surface.

An adjustable length extension arm 54 is connected between the leveraging extension 52 and a bracket 56 disposed at an intermediate location on the upright support member 12. A fastener 58*a* (e.g., bolt, screw, rivet or the like) connects an outer segment 62 to the leveraging extension and a fastener 58*b* (e.g., bolt, screw, rivet or the like) connects an inner segment 64 of the extension arm 54 to the bracket 56. An adjustment mechanism 60 is operable disposed on or otherwise disposed in relation to the extension arm 54 and is used to selectively alter the length of the extension arm 54. Alteration of the length of the extension arm 54 correspondingly raises or lowers the leveraging extension 52, thereby altering the height of the basketball goal 18 in relation to the playing surface.

Figure 2:
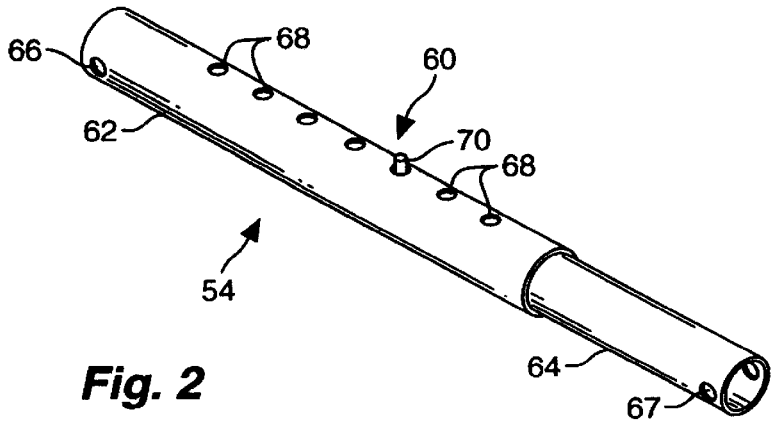
FIG. 2 is a perspective view of an extension arm of the embodiment as illustrated in FIG. 1.

FIG. 2 shows the extension arm 54 and adjustment mechanism 60 of FIG. 1 in greater detail. As shown, the extension arm 54 of the depicted presently preferred embodiment is comprised of the outer segment 62 and the inner segment 64. The outer segment 62 is provided with holes 66 for the fastener 58*a* (of FIG. 1). The inner segment 64 is provided with holes 67 for the fastener 58*b*. Included in the adjustment mechanism 60 of the depicted embodiment are a series of aligned holes 68 formed in the outer segment 62 in spaced apart relation. A spring-biased push button mechanism 70 may be disposed within the inner segment 64 so as to protrude through at least one of the aligned holes 68. The spring-biased push button mechanism 70 also protrudes through a hole 72 formed in the inner segment 64, which is best viewed in FIG. 3.

Figure 3:
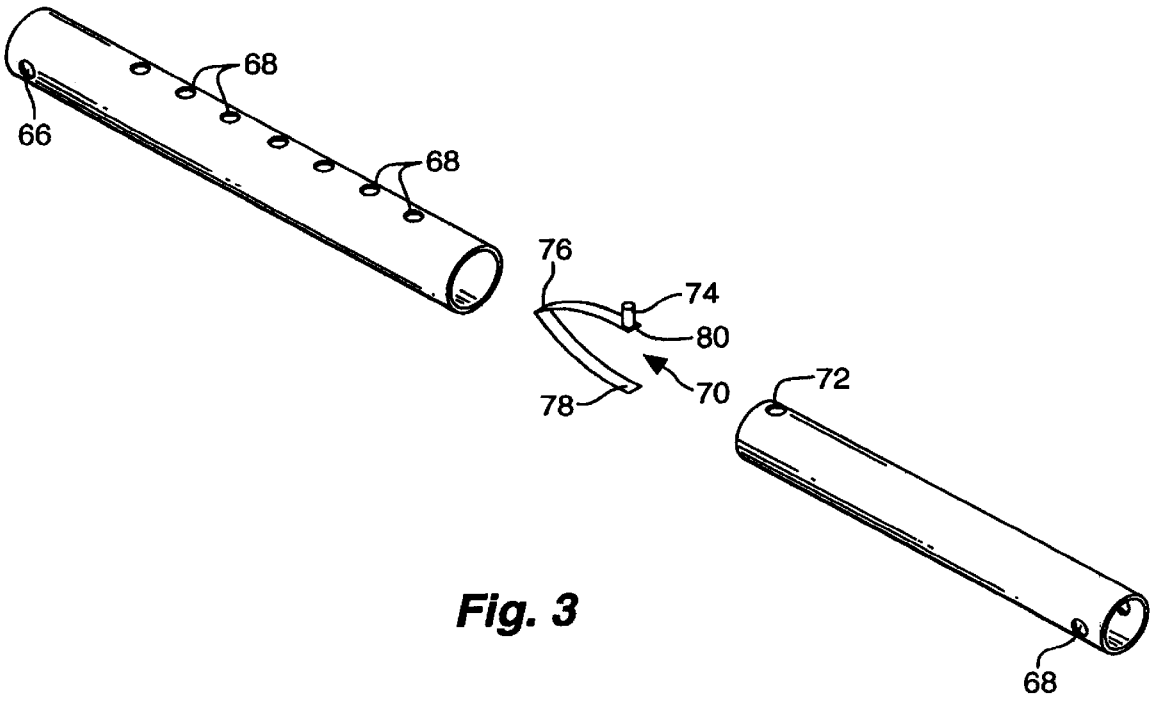
FIG. 3 is an exploded view of the extension arm as illustrated in FIG. 2.

One presently preferred embodiment of a spring-biased push button mechanism 70 of the present invention is shown in the exploded view of FIG. 3. As seen therein, the spring-loaded push button mechanism 70 is provided with a engaging head 74 which is fixed to a proximal side 80 of a spring clip 76. The spring clip 76 is preferably formed from a resilient metal strip bent over on itself and having a distal side 78 which, when compressed within the inner segment 64, exerts an outward force on the engaging head 74. This outward force or biasing maintains the spring-loaded push button mechanism 70 in an engaged position within the inner segment 64 with the head 74 extending through the hole 72 and one of the aligned holes 68 of the outer segment 62.

With the one-handed push button adjustment mechanism 60 of the present invention, a user can adjust the height of the basketball goal assembly 10 using a single hand while standing on the playing surface 15. Depressing the engaging head 74 of the spring-biased push button mechanism 70 releases the adjustment mechanism 60 onto a disengaged position. At this instance, the outer segment 62 of the extension arm 54 is free to move relative to the inner segment 64 with a telescoping motion. An upward motion lengthens the extension arm 54 and adjusts the basketball goal 18 to a lower height above the playing surface 15. Likewise, a downward motion of the outer segment 62 relative to the inner segment 64 adjusts the basketball goal 18 to a greater height above the playing surface.

Even if the engaging head 74 of the spring-biased push button mechanism 70 is inadvertently impacted and temporarily depressed, the basketball goal 18 will be allowed to move only slightly or not at all. After the impacting force is terminated, the expansive force of the spring-biased push button mechanism 70 will cause the engaging head 74 to protrude out of the first of the aligned holes 68 with which it comes into alignment, stopping any further movement. Also, the counterbalancing force of the coil spring 46 prevents the basketball goal 18 from any significant amount of displacement.

Figure 4:
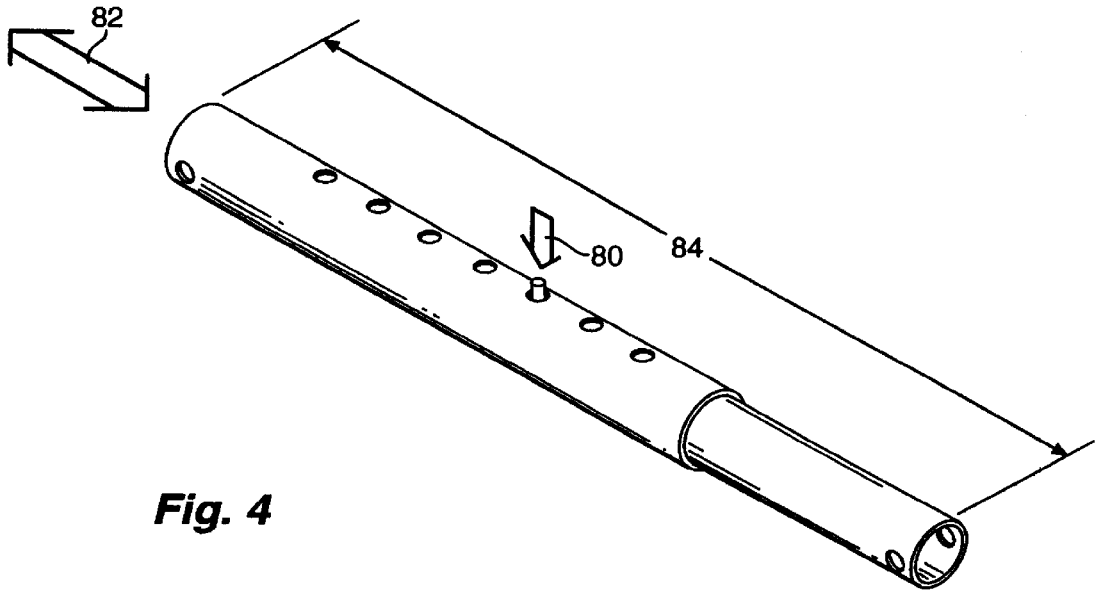
FIG. 4 is a perspective view of the extension arm of FIG. 2, illustrating one manner of adjusting the length of the extension arm.

With reference now to FIG. 4, one manner of use of the adjustment mechanism 60 to adjust the height of the basketball goal 18 is further illustrated. As shown, an inward force, depicted by an arrow 80, on the head 74 of the spring-biased push button mechanism 70 disengages the adjustment mechanism 60. The upper and inner segments 62, 64 are then free to move relative to each other until the spring-biased push button mechanism 70 contacts the next of the aligned holes 68. The counterbalancing mechanism, depicted in the form of the coil spring 46 as illustrated in FIG. 1, maintains a substantial detente in the height of the basketball goal, such that only a small force is necessary to move the inner and outer segments 64, 62 relative to each other.

The user can grip the outer segment 62 with a single hand, while depressing the engaging head 74 of the spring-biased push button mechanism 70 and subsequently moving the outer segment 62 up or down, as shown by an arrow 82, to adjust the length of the extension arm 54 depicted by dimension 84. In operation, the head 74 remains depressed by the wall of the outer segment 62 until it becomes aligned with the next of the sequential aligned holes 68, at which time the expansive force of the bent over and compressed spring clip 76 forces the engaging head 74 to pop out through the particular aligned hole 68, once again placing the adjustment mechanism 60 in the engaged position. If it is desired to adjust the height of the basketball goal 18 further, the process is repeated until the basketball goal 18 is disposed in the desired position.

Figure 5:
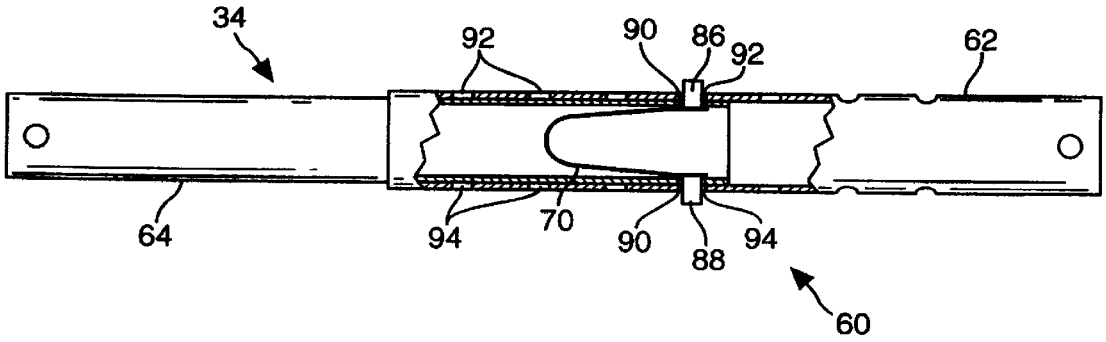
FIG. 5 is a cut away view of a further embodiment of an extension arm of the present invention.

FIG. 5 illustrates a further embodiment of the extension arm 54 and adjustment mechanism 60 of the present invention. As shown, the spring-biased push button mechanism 70 resides within the inner segment 64, but instead of a single head 74, a pair of engaging heads 86, 88 protrude through the opposing holes 90 in the inner segment 64 and opposing set of aligned holes 92, 94 in the outer segment 62. Thus, the user simultaneously, and with a single hand, may depress the engaging heads 86, 88 of the spring-biased locking mechanism 70 to achieve the disengaged position, while adjusting the length of the extension arm 54 by moving the outer segment 62 in relation to the inner segment 64. As appreciated, the incorporation of at least two engaging heads 86, 88 provides further insurance that a stray ball or other object will not inadvertently disengage the adjustment mechanism 60.

In this manner, the height of the basketball goal 18 may be adjusted without the aid of a separate adjustment pole, ladder, stool or the like. Further, with the adjustment mechanism 60 located on the back side 28 of the rigid support member 12, the adjustment mechanism 60 is less likely to interfere with game play or be struck by a stray ball. The aligned holes 68 and the spring-biased push button mechanism 70 preferably face the support member 12, further protecting the adjustment mechanism 60 from being inadvertently contacted by a stray basketball or other objects.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A basketball goal assembly allowing for adjustment of the height of a basketball goal above a playing surface, said basketball goal assembly comprising:

a rigid support member;

a goal support structure connected to said support member, said goal support structure being deformable into a plurality of configurations wherein at each configuration said basketball goal is disposed at a different height above said playing surface;

an extension arm having a first end connected to said goal support structure and a second opposing end connected to said support member, said extension arm having an adjustable length disposed between said first and second ends such that adjusting the length of the extension arm selectively deforms the goal support structure;

an adjustment mechanism operably disposed in relation to said extension arm, said adjustment mechanism capable of being disposed between an engaged position wherein the length of the extension arm is restricted from adjustment and a disengaged position wherein the length of the extension arm may be freely adjusted; and a counterbalance member having a first end connected to said goal support structure and a second end connected to said basketball goal, said counterbalance member providing sufficient support to facilitate a counterbalancing between the weight of the basketball goal and a force applied to said extension arm.

2. An adjustable basketball goal assembly as defined in claim 1, wherein said goal support structure is substantially parallelogramic in configuration.

3. An adjustable basketball goal assembly as defined in claim 1, wherein said goal support structure comprises an upper linkage arm and a lower linkage arm.

4. An adjustable basketball goal assembly as defined in claim 3, further comprising a leveraging extension on at least one of the upper and lower linkage arms which protrudes substantially outward from said support member.

5. An adjustable basketball goal assembly as defined in claim 4, wherein said first end of said extension arm is pivotally connected to the leveraging extension such that said leveraging extension provides sufficient leverage to assist in deforming said goal support structure when a length of the extension arm is adjusted.

6. An adjustable basketball goal assembly as defined in claim 3, wherein said counterbalance member is dynamically disposed to apply a compressive force between said upper linkage arm and said lower linkage arm.

7. An adjustable basketball goal as defined in claim 1, further comprising a backing plate connected to said goal support structure.

8. An adjustable basketball goal assembly as defined in claim 1, wherein said extension arm comprises an inner segment and an outer segment disposed in telescoping engagement and configured such that the inner and outer segments may be selectively fixed relative to each other and, alternatively, selectively freed to move relative to each other.

9. An adjustable basketball goal assembly as defined in claim 8, wherein said inner and outer segments are each configured with a hole, said holes positioned to align with each other when the inner and outer segments are disposed in said engaged position.

10. The adjustable basketball goal assembly as defined in claim 9, wherein said inner and outer segments comprise substantially concentric cylinders, with the inner segment positionable within the outer segment.

11. An adjustable basketball goal assembly as defined in claim 10, wherein said adjustment mechanism comprises a spring-loaded push button mechanism positionable within said inner and outer segments of said extension arm to extend through said holes when the adjustment mechanism is disposed in said engaged position, thereby fixing the inner and outer segments relative to each other.

12. An adjustable basketball goal assembly as defined in claim 11, wherein said adjustment mechanism comprises a spring-biased push button mechanism biased into said engaged position such that upon application of a sufficient force to said push button mechanism, the push button mechanism may be disengaged from said hole in said outer segment, thereby transitioning the adjustment mechanism to said disengaged position to permit relative movement between said inner and outer segments.

13. An adjustable basketball goal assembly as defined in claim 11, wherein said outer segment is configured with an array of aligned holes, wherein each hole corresponds to a different selected height of said basketball goal when said hole is engaged by said spring-biased push button mechanism.

14. An adjustable basketball goal assembly as defined in claim 11, wherein said spring-biased push button mechanism comprises a protruding head and a spring clip attached to said head, said spring clip compressed within said inner segment of said extension arm to apply an outward force on the head.

15. An adjustable basketball goal assembly as defined in claim 11, wherein said adjustment mechanism is operably disposed facing the support member in such a manner to protect the adjustment mechanism from inadvertently being transitioned out of said engaged position.

16. An adjustable basketball goal assembly allowing for adjustment of the height of a basketball goal above a playing surface, said basketball goal assembly comprising:

a rigid support member;

a substantially parallelogramic goal support structure pivotally connected to said support member, said goal support structure being deformable into a plurality of configurations wherein at each configuration the basketball goal is disposed at a different height above said playing surface;

an extension arm having a first end connected to said goal support structure and a second opposing end connected to said support member, said extension arm having an adjustable length disposed between said first and second ends such that adjusting the length of the extension arm selectively deforms the goal support structure;

said extension arm comprising an inner segment and an outer segment disposed in telescoping engagement and configured such that the inner and outer segments may be selectively moved relative to each other;

an adjustment mechanism operably disposed in relation to said extension arm, said adjustment mechanism capable of being disposed between an engaged position wherein the length of the extension arm is restricted from adjustment and a disengaged position wherein the length of the extension arm may be freely adjusted;

each of said inner and outer segments of said extension arm being configured with at least one hole, said holes selectively positionable to align with each other when the inner and outer segments are disposed in said engaged position;

said adjustment mechanism comprising a spring-biased locking mechanism selectively extendable through said holes of said inner and outer segments when the adjustment mechanism is disposed in said engaged position, thereby fixing the inner and outer segments relative to each other until application of a sufficient force to disengage said spring-biased locking mechanism from said hole in the outer segment, thereby transitioning the adjustment mechanism to the disengaged position and permitting relative movement between the inner and outer segments of said extension arm; and a counterbalance member having a first end connected to said goal support structure and a second end connected to said basketball goal, said counterbalance member providing support to facilitate a counterbalancing between the weight of said basketball goal and a force applied to said extension arm.

17. An adjustable basketball goal assembly as defined in claim 16, wherein said goal support structure comprises an upper linkage arm and a lower linkage arm.

18. An adjustable basketball goal assembly as defined in claim 17, wherein said counterbalance member is dynamically disposed to apply a compressive force between said upper linkage arm and said lower linkage arm.

19. An adjustable basketball goal assembly as defined in claim 16, wherein said outer segment of said extension arm is configured with an array of aligned holes, wherein each hole corresponds to a different selected height of said basketball goal when said hole is engaged by said spring-biased locking mechanism.

20. An adjustable basketball goal assembly allowing for adjustment of the height of a basketball goal above a playing surface, said basketball goal assembly comprising:

a rigid support member;

a mounting bracket connected to said support member;

a goal support structure pivotally connected to said support member, said goal support structure being deformable into a plurality of configurations wherein at each configuration the basketball goal is disposed at a different height above said playing surface;

an extension arm having a first end connected to said goal support structure and a second opposing end pivotally connected to said mounting bracket such that adjusting the disposition of the extension arm relative to the mounting bracket selectively deforms the goal support structure and adjusts the height of said basketball goal above said playing surface, said extension arm comprising a length having a plurality of receiving holes disposed longitudinally along said length;

an adjustment mechanism operably disposed in relation to said extension arm, said adjustment mechanism capable of engaging at least one of said receiving holes formed in the extension arm, said adjustment mechanism positionable between an engaged position wherein the disposition of the extension arm is fixed with regard to said mounting bracket and a disengaged position wherein the disposition of the extension arm may be freely adjusted over a selected range of movement; and a counterbalance member having a first end connected to said goal support structure and a second end connected to said basketball goal, said counterbalance member being sufficiently resilient so as to provide support to facilitate a counterbalancing between the weight of the basketball goal and a force applied to said extension arm.

21. A method for adjusting the height of a basketball goal assembly over a playing surface, said basketball goal assembly comprising a basketball goal attached to a goal support structure and secured to a support member in relation to said playing surface, an extension arm having a first end connected to the goal support structure, a second opposing end connected to the support member and an adjustable length disposed between said first and second ends, an adjustment mechanism operably disposed relative to the extension arm for adjusting said deformation of the goal support structure at any one of a plurality of configurations such that the basketball goal is suspended above the playing surface at one of a plurality of heights, said adjustment mechanism having an engaged position wherein the length of the extension arm is restricted from being adjusted and a disengaged position wherein the length of the extension arm may be freely adjusted, and a counterbalance member operably disposed in relation to the goal support structure, said counterbalance member providing sufficient support to facilitate a counterbalancing between the weight of the basketball goal and a tensile force applied to the extension arm, said method comprising the steps of:

disposing said adjustment mechanism in said disengaged position;

deforming said goal support structure while maintaining said adjustment mechanism in said disengaged position; and disposing said adjustment mechanism in said engaged position.

22. An adjustment method for a basketball goal assembly as defined in claim 21, wherein said extension arm comprises an inner segment and an outer segment operably disposed in telescoping engagement and configured such that said inner and outer segments may be transitioned between said engaged position in which the inner segment and the outer segment are fixed relative to each other and said disengaged position in which the inner segment and the outer segment are free to selectively move relative to each other, and wherein deforming said goal support structure comprises moving the inner and outer segments relative to the other.

23. An adjustment method for a basketball goal assembly as defined in claim 22, wherein each of said inner and outer segments are configured with a hole, each of said holes positioned to align with each other when the inner and outer segments are disposed in said engaged position.

24. An adjustment method for a basketball goal assembly as defined in claim 22, said adjustment mechanism further comprising a spring-biased locking mechanism selectively positionable within said holes of said inner and outer segments of said extension arm, said spring-biased locking mechanism biased towards said engaged position such that upon application of a sufficient depression force, said spring-biased locking mechanism is disengaged from said hole in said outer segment and transitions into said disengaged position to permit relative movement between the inner and outer segments.

25. An adjustment method for a basketball goal assembly as defined in claim 21, wherein disposing said adjustment mechanism in said disengaged position, deforming said goal support structure, and disposing said adjustment mechanism in said disengaged position can be performed using a single hand of a user.

* * * * *